United States Patent [19]

Wilcox et al.

[11] 3,989,181

[45] Nov. 2, 1976

[54] PARTITIONED CONTAINER HAVING SELF LOCKING TOP AND BOTTOM FORMING FLAPS

[75] Inventors: Thomas L. Wilcox, Indianapolis; Ancil A. Jones, Mooresville, both of Ind.

[73] Assignee: Inland Container Corporation, Indianapolis, Ind.

[22] Filed: Jan. 21, 1976

[21] Appl. No.: 650,892

[52] U.S. Cl. ..... 229/39 R; 229/38; 229/41 B; 229/45 R; 229/27

[51] Int. Cl.[2] ..... B65D 5/10

[58] Field of Search ..... 229/38, 39 R, 27, 40, 229/52 B, 52 BC, 41 R, 41 B, 44, 45

[56] References Cited

UNITED STATES PATENTS

| | | | |
|---|---|---|---|
| 1,971,198 | 8/1934 | Ottinger | 229/45 X |
| 2,315,094 | 3/1943 | Rehfield et al. | 229/38 X |
| 2,327,529 | 8/1943 | Kieckhefer | 229/51 DB X |
| 2,333,244 | 11/1943 | Gordon | 229/44 X |
| 2,400,443 | 5/1946 | Stopper | 229/39 |
| 2,737,338 | 3/1956 | Moore | 229/45 |
| 3,049,279 | 8/1962 | Mairs et al. | 229/41 B X |
| 3,093,291 | 6/1963 | Brandle | 229/45 X |
| 3,199,762 | 8/1965 | Coons | 229/27 |
| 3,302,853 | 2/1967 | Locke | 229/39 |
| 3,512,697 | 5/1970 | Robinson | 229/45 X |
| 3,921,896 | 11/1975 | Ishimura | 229/44 R X |

*Primary Examiner*—Davis T. Moorhead
*Attorney, Agent, or Firm*—Fitch, Even, Tabin & Luedeka

[57] ABSTRACT

A partitioned container and method and blank for making the same are disclosed wherein a partition panel is formed integral with one end of the blank and is foldable with and selectively adhesively secured to side wall panels to form a partitioned container having top and bottom forming flaps which are self-locking when in folded positions so that conventional stapling, stitching or taping of the top and bottom flaps is eliminated.

19 Claims, 7 Drawing Figures

PARTITIONED CONTAINER HAVING SELF LOCKING TOP AND BOTTOM FORMING FLAPS

The present invention relates generally to containers or cartons conventionally made of paperboard material or the like, and more particularly to a partitioned container having an integral partition panel and self-locking top and bottom forming flaps.

One of the primary objects of the present invention is to provide a novel partitioned container employing a one-piece blank construction which facilitates automatic positioning of the partition panel between opposite side wall panels without severing the partition panel from the one-piece blank when the container is being erected.

Another object of the present invention is to provide a novel partitioned container having self-locking top and bottom forming flaps which eliminate stapling, taping, stitching and gluing of the top and bottom flaps to maintain them in folded positions during erection of the container.

Another object of the present invention is to provide a one-piece blank for making a partitioned container having self-locking top and bottom forming flaps, which container employs no more board stock than partitioned containers of the type having double-glued-in partition liners.

A feature of the invention lies in the provision of reinforced hand holes which substantially strengthen the container adjacent the hand holes.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
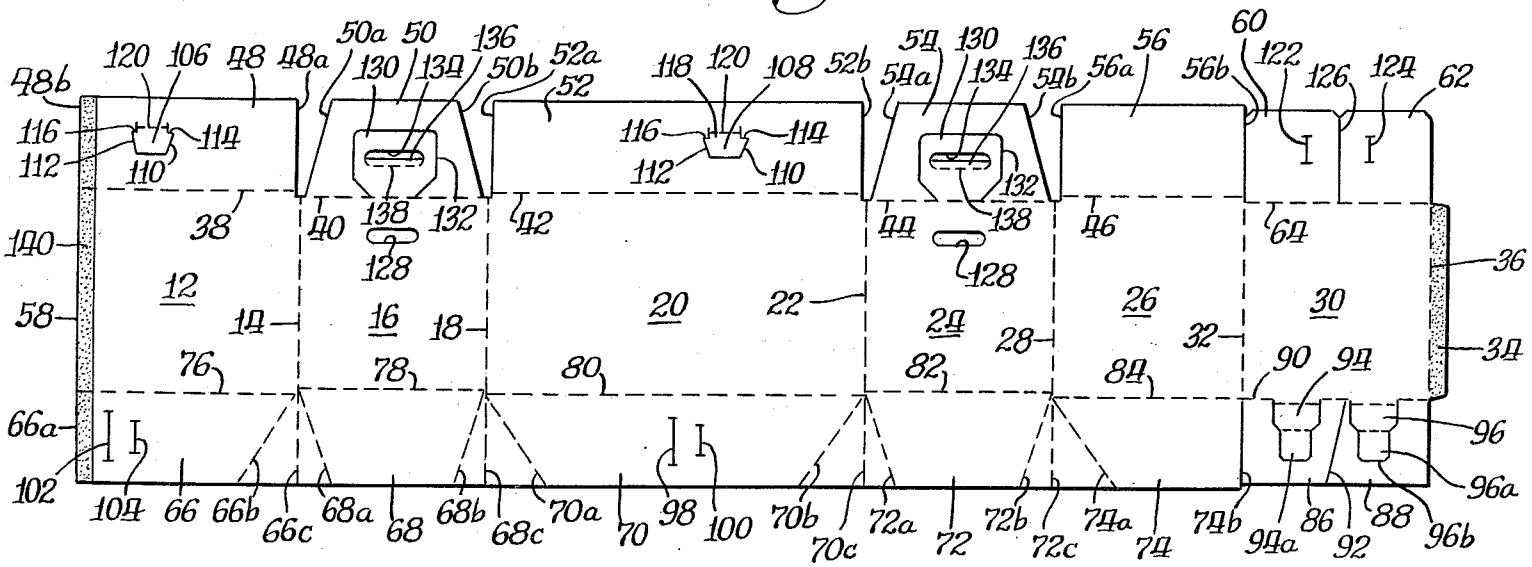
FIG. 1 is a plan view of a blank for use in constructing a partitioned container in accordance with the present invention.

Referring now to the drawings, and in particular to FIG. 1, a blank of paperboard material or the like from which a container in accordance with the present invention is constructed is indicated generally at 10. The blank 10 is of generally rectangular plan configuration and includes, in order, a first substantially rectangular side panel portion 12 hingedly connected by a fold or hinge line 14 to a first end panel 16 which is hingedly connected by a fold line 18 to a side panel 20. The side panel 20 is hingedly connected by a fold line 22 to a second end panel 24 to which is also hingedly connected a second side panel portion 26 about a fold line 28. As will become more apparent hereinbelow, the side panel portions 12 and 26 are cooperative to form a container side panel of equal area to the side panel 20.

A partition panel 30 is formed integral with the blank 10 and is hingedly connected to the second side panel portion 26 by a fold line 32. The partition panel 30 has a glue flap 34 hingedly connected thereto about a fold line 36. As will be described more fully below, in erecting a partitioned container from the blank 10 in accordance with the present invention, the partition glue flap 34 will have deposited on its upwardly facing surface, as considered in FIG. 1, a layer of suitable adhesive material, the adhesive being applied by any suitable means (not shown).

Hingedly connected to the upper marginal edges of the panels 12, 16, 20, 24 and 26, at fold lines 38, 40, 42, 44 and 46, respectively, are top forming flaps 48, 50, 52, 54 and 56. The top forming flaps 48, 50, 52, 54 and 56 are of the regular slotted container (RSC) type which are separated be beveled cut edges as indicated at 48*a*, 50*a*, 50*b*, 52*a*, 52*b*, 54*a*, 54*b* and 56*a*. The beveled cut edges defining the lateral edges of the top forming flaps 48, 50, 52, 54 and 56 facilitate folding of the top flaps into substantially coplanar relation during forming of a closed top, but the top flaps may, if desired, be separated by cut lines which are in alignment with the respective fold lines 14, 18, 22 and 28. It is seen that the top flap 48 and the top flap 56 associated with the first and second side panel portions 12 and 26, respectively, are defined at their lateral edges opposite the edges 48*a* and 56*a*, respectively, by marginal edges 48*b* and 56*b*. The lateral edge 48*b* is aligned with a marginal edge 58 which forms the edge of both the blank 10 and the side panel portion 12. The edge 56*b* of the top flap 56 is aligned with the fold line 32 and separates the top flap 56 from a pair of upper or top locking flaps 60 and 62 which are hingedly connected to the upper marginal edge of the partition panel 30 by a common fold line 64.

Bottom forming flaps 66, 68, 70, 72 and 74 are hingedly connected to the lower or bottom marginal edges of the respective panels 12, 16, 20, 24 and 26 by fold lines 76, 78, 80, 82 and 84, respectively. Unlike the top forming flaps 48, 50, 52, 54 and 56, the bottom forming flaps 66, 68, 70, 72 and 74 are connected along fold lines so as to form a bellows bottom when the container blank 10 is erected into a container. To this end, bellows forming fold lines 66*b*, 66*c* and 68*a* are formed between the bottom flaps 66 and 68; bellows forming fold lines 68*b*, 68*c* and 70*a* are formed between the bottom flaps 68 and 70; bellows forming fold lines 70*b*, 70*c* and 72*a* are formed between the bottom flaps 70 and 72; and bellows forming fold lines 72*b*, 72*c* and 74*a* are formed between the bottom flaps 72 and 74. The bellows forming fold lines 66*c*, 68*c*, 70*c* and 72*b* are aligned, respectively, with the fold lines 14, 18, 22 and 28. The bellows forming fold lines 68*a*, 68*b*, 72*a* and 72*b* form included angles of approximately 10° with their associated bellows forming fold lines 66*c*, 68*c*, 70*c* and 72*c*, respectively. The bellows forming fold lines 66*b*, 70*a*, 70*b* and 74*a* form included angles of approximately 35° with the associated bellows forming fold lines 66*c*, 68*c*, 70*c*, and 72*c*.

The lateral marginal edge of the bottom flap 66 opposite the bellows fold line 66*b* is defined by an edge 66*a* which is an extension of the lateral edge 58 of the side panel portion 12. The lateral edge of the bottom flap 74 opposite the bellows fold line 74*a* is defined by a cut line 74*b* which separates the bottom flap 74 from a pair of bottom flaps 86 and 88 hingedly connected to the bottom marginal edge of the partition panel 30 by a fold line 90.

The bottom flaps 86 and 88 are separated from each other by an angled cut line 92 so that the flaps 86 and 88 may be folded about the fold line 90 in opposite directions relative to the plane of the partition panel 30. The bottom flaps 86 and 88 define identically shaped locking tabs 94 and 96, respectively. The locking tabs 94 and 96 are integrally connected to the partition panel 30 along the fold line 90 but are foldable from the planes of their respective bottom flaps 86 and 88 along cut lines as shown in FIG. 1. In this manner, the locking tabs 94 and 96 may be folded outwardly from the planes of their respective bottom flaps about the fold line 90 during erection of the container blank 10. Each of the locking tabs 94 and 96 includes a generally rectangular shaped end portion 94*a* and 96*a*, respectively, of slightly reduced size from the portions of the locking tabs directly hingedly connected to the partition panel 30.

During erection of the blank 10 into a partitioned container, the locking tabs 94 and 96 are inserted, respectively, through pairs of parallel spaced cuts or slots 98, 100 and 102, 104 for effecting self-locking of the bottom panels 66, 68, 70, 72 and 74 when folded into substantially coplanar relation to form the bottom of the container. As will be described, the respective pairs of slots 98, 100 and 102, 104 are adapted to receive either of the locking tabs 94 or 96 in locking relation therewith.

Each of the top forming flaps 48 and 52 has a locking tab 106 and 108, respectively, formed therein. The locking tabs 106 and 108 are of identical configuration and each is defined by a cut line through the paperboard material so as to define tapered lateral edges 110 and 112 which terminate at their upper ends, as considered in FIG. 1, in retaining edges 114 and 116 adjacent a neck portion 118, each of locking tabs 106 and 108 being foldable outwardly of the plane of its respective top flap 48 and 52.

During assembly of the blank 10 into a partitioned container, each of the locking tabs 106 and 108 is received through one of a pair of slits 122 or 124 formed by cut lines in the top locking flaps 60 and 62, the slits 106 and 108 being parallel to the cut line 56*b*. The top locking flaps 60 and 62 are of substantially equal size and are separated by a cut line 126 such that the locking flaps 60 and 62 may be folded in opposite directions about the fold line 64 to positions lying in a plane substantially perpendicular to the plane of the partition panel 30.

Figure 7:
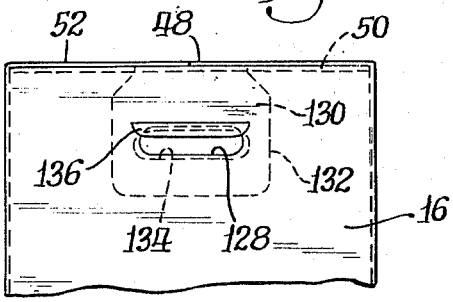
FIG. 7 is a partial enlarged end view illustrating a reinforced hand hole of a container constructed from the blank of FIG. 1.

Each of the end panels 16 and 24 has an elongated hand hole or opening 128 formed therein. The top forming flaps 50 and 54 associated with the respective end panels 16 and 24 have generally rectangular shaped reinforcing panels 130 formed therein by cut lines 132. The reinforcing panels 130 are foldable about their respective fold lines 40 and 44 into positions lying against the associated end panels 16 and 24 adjacent the hand holes 128 and are cooperative with the hand holes to provide reinforcing means for the end panels 16 and 24 adjacent the hand holes 128. To this end, each of the reinforcing panels 130 has an opening 134 formed therein one edge of which is defined by a retaining flap or tab 136 foldable about a fold line 138 so that the resulting opening is approximately equal in area to a hand hole 128. When the reinforcing panels 130 are folded inwardly in juxtaposition to their respective end panels 16 and 18 about the fold lines 40 and 44, the retaining flaps 136 are inserted through the corresponding hand holes 128 and serve to retain the respective reinforcing panels 130 in their folded positions, as best seen in FIG. 7. In this manner, the end panels 16 and 24 are reinforced by the panels 130 adjacent the hand holes 128.

Figure 2:
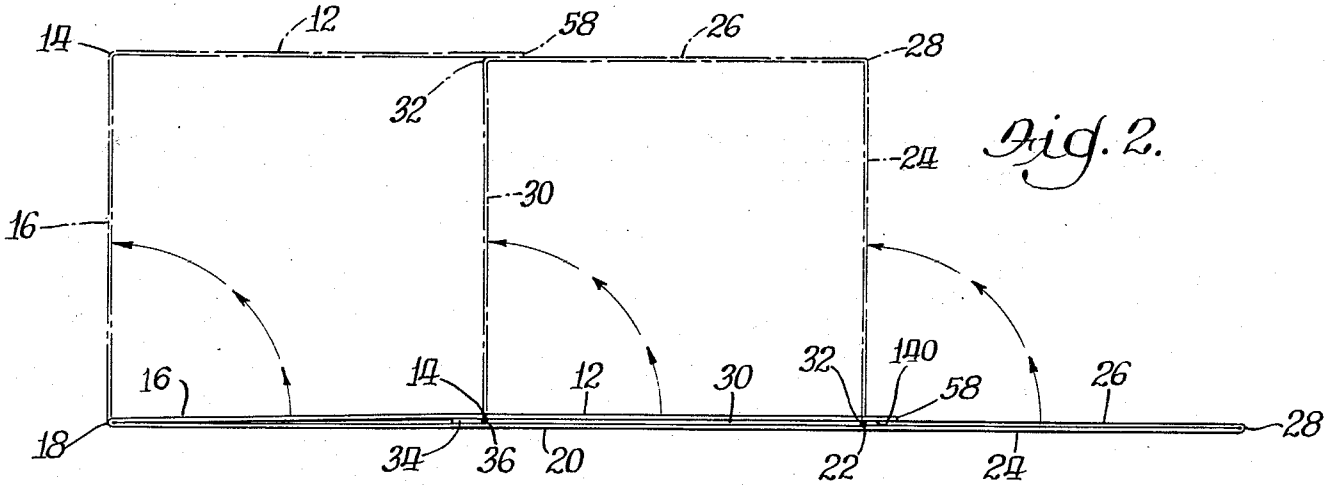
FIG. 2 is an enlarged edge view of the blank of FIG. 1 with the respective partition and wall panels being shown in solid lines in an intermediate step of construction, and being shown in phantom in their erected positions.
Figure 3:
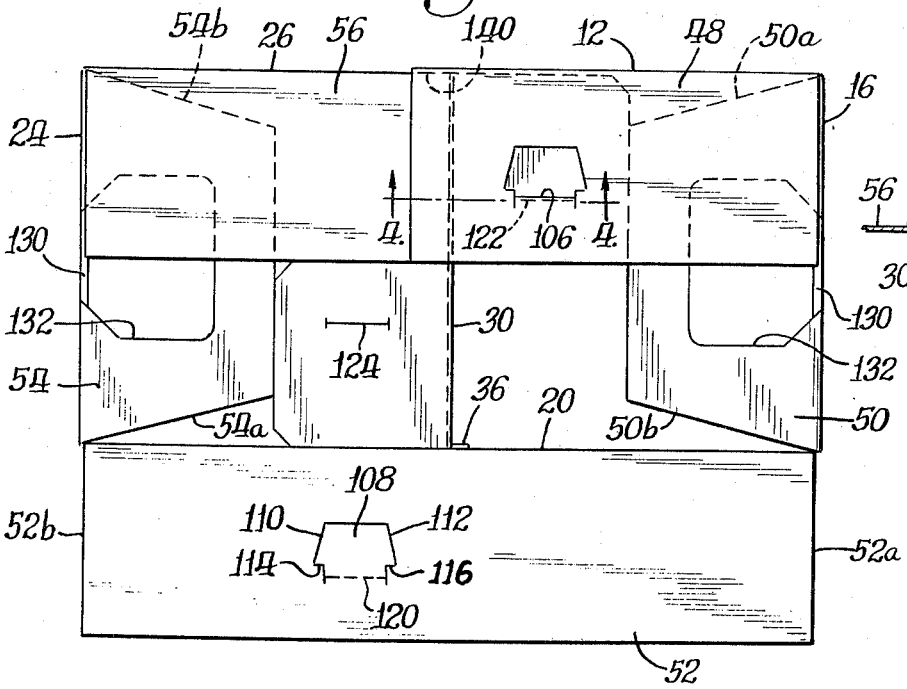
FIG. 3 is an enlarged top view of an erected container in accordance with the present invention, one of the top side flaps being in open position to better illustrate the self-locking feature of the top forming flaps.

With reference to FIGS. 2–7, one method of erecting a partitioned container from the flat blank 10 includes applying an adhesive to the upwardly facing surface of the partition glue flap 34 by suitable means (not shown). A suitable adhesive is also applied to an upwardly facing edge surface, indicated by the shaded area 140, on the side panel portion 12 and associated upper and lower flaps 48 and 66. The side panel portion 26 and partition panel 30 are then folded about the fold line 28 to a position overlying the coplanar end panel 24 and side panel 20, and the adhesive glue strip 34 is secured to the upwardly facing surface of the side panel 20 such that the fold line 36 is disposed at substantially the mid-length of the panel 20, as shown in FIG. 2. The side panel portion 12 and end panel 16 are then folded about the fold line 18 to a position overlying the remaining exposed surface of the side panel 20 and the upwardly facing surfaces of the previously folded partition panel 30 and side panel portion 26. The adhesive strip 140 is then secured to the exposed surfaces of the side panel portion 26 and end flaps 56 and 74 adjacent the fold line 32 and associated aligned cut lines 56*b* and 74*b*. Thereafter, the thus folded container blank is manipulated into a generally rectangular plan configuration, as shown in phantom in FIG. 2, wherein two side-by-side generally square or rectangular compartments are defined between opposite end panels 16 and 24, and the opposing side panels 12, 20 and 26. During this preliminary folding, it will be appreciated that the top and bottom forming flaps remain in generally coplanar relation with their respective side and end panels.

Figure 5:
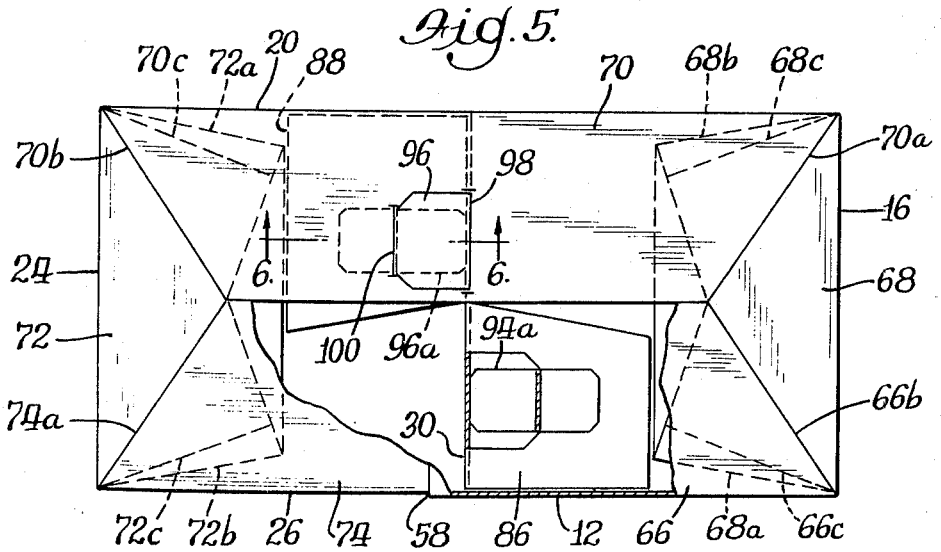
FIG. 5 is an enlarged bottom view of the erected container with a portion of one bottom side flap being broken away to better illustrate the self-locking feature of the bottom forming flaps.

In forming the bottom closure of the container, the bottom flaps 86 and 88 on the partition panel 30 are folded about the fold line 90 in opposite directions to lie in a common plane substantially perpendicular to the partition panel 30, as shown in FIG. 5. The locking tabs 94 and 96 are then folded outwardly about the fold line 90 from their flaps 86 and 88, respectively. The bottom forming flaps 68 and 72 are folded downwardly into a common plane about their fold lines 78 and 82, respectively. Because the bottom forming flaps are interconnected to form a "bellows" bottom, the bottom forming flap 70 and the connected bottom forming flaps 66 and 74 are folded downwardly to their folded positions substantially simultaneously with folding of the bottom flaps 68 and 72.

Figure 6:
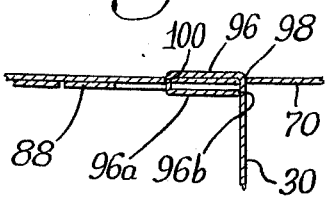
FIG. 6 is a partial sectional view taken substantially along the line 6—6 of FIG. 5, looking in the direction of the arrows.

The paperboard material of the blank 10 is flexible enough to allow the outwardly projecting locking tabs 94 and 96 to be inserted upwardly through the slits 102 and 98, respectively, in the bottom flaps 70 and 66 as these bottom flaps are folded to form the bottom of the container. With reference to FIG. 6 and locking tab 96 as exemplifying the locking relationship of the locking tabs 94 and 96 with the respective bottom forming flaps 66 and 70, after the locking tab 96 has been inserted outwardly through the slit 98, the bottom forming flap 70 is folded further downwardly to its bottom forming position whereafter the end portion 96*a* of the locking tab 96 is inserted inwardly through the slit 100. The tab end portion 96*a* is then folded toward the partition panel 30 so that the tab portion 96*a* is juxtaposed to the bottom forming flap 70. The length of the tab end portion 96*a* is preferably made sufficient to effect frictional engagement of the free edge 96*b* of the tab end with the partition panel 30 to further enhance the locking relation and prevent accidental withdrawal of tab 96 from the slits 98 and 100, as shown in FIG. 6.

After folding the bottom forming flaps into substantially coplanar relation and effecting self-locking thereof as described, the container may be inverted and filled as desired. Thereafter, the top locking flaps 60 and 62 are folded about the fold line 64 in opposite directions to positions lying in a plane substantially normal to the plane of the partition panel 30. The top forming flaps 50 and 54 are then folded to positions lying substantially in the plane of the upper fold lines 38, 40, 42, 44 and 46. The reinforcing panels 130 are simultaneously folded out of the planes of their respective top forming flaps so as to lie in juxtaposition to the respective end panels 16 and 24. The retaining tabs 136 are then inserted through the respective hand holes 128 to retain the reinforcing panels 130 against the end panels 16 and 24 adjacent the hand holes.

Figure 4:
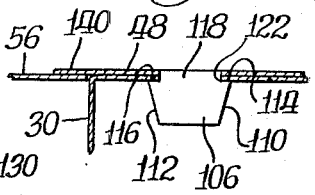
FIG. 4 is a partial sectional view taken substantially along line 4—4 of FIG. 3, looking in the direction of the arrows.

The top forming flaps 52 and secured top flaps 48 and 56 are then folded downwardly while simultaneously depressing the locking tabs 106 and 108 from the planes of their respective flaps 48 and 52 so that the locking tabs 106 and 108 may be inserted through the slits 124 and 122, respectively. As shown in FIG. 4, folding the top forming flaps 52 and 48 to their downward folded positions with simultaneous insertion of the locking tabs 106 and 108 through the slits 124 and 122, respectively, will effect locking of the top forming flaps in their folded positions by virtue of retaining edges 114 and 116 on the locking tabs being disposed slightly below the respective top locking flaps 60 and 62 and preventing accidental withdrawal of the locking tabs from the locking flaps whereby to retain the top forming flaps in their folded positions.

Having thus described a preferred embodiment of the blank 10 in accordance with the present invention, and the various features of the container formed from the blank, including the reinforced handle holes and the self-locking top and bottom forming flaps, it will be appreciated that changes and modifications may be made in the specific configuration disclosed without departing from the invention in its broader aspects. Various features of the invention are defined in the following claims.

What is claimed is:

1. A container blank for use in constructing a partitioned container, said blank comprising a unitary sheet material which includes, in order, two pairs of wall panels secured on parallel hinge lines, one wall panel of one pair being disposed between said panels of said other pair, the other wall panel of said one pair comprising two wall panel portions one portion of which is hingedly connected to one panel of said other pair of wall panels, the other portion of said two wall panel portions being hingedly connected to the other one of said other pair of wall panels, one of said two wall panel portions having a partition panel hingedly secured thereto, a partition glue-flap hingedly secured to said partition panel, the other of said two wall panel portions having a container glue-flap, each wall panel of said two pairs of wall panels having top and bottom forming flaps hingedly secured to the opposite ends thereof along hinge lines substantially perpendicular to said hinge lines of said two pairs of wall panels, said top and bottom forming flaps being foldable to form closed top and bottom covers for a container formed from said blank, said partition panel having top and bottom partition flaps hingedly secured thereto along hinge lines substantially perpendicular to said hinge lines of said two pairs of wall panels, said top and bottom partition flaps each defining means adapted for interlocking cooperation, respectively, with selected ones of said top and bottom forming flaps to maintain said top and bottom forming flaps in their said folded positions when folded to form said closed top and bottom covers.

2. A container blank as defined in claim 1 wherein said top and bottom forming flaps having configurations such that selected ones of said top and bottom flaps retain the remaining of said top and bottom forming flaps in their said folded positions when said blank is manipulated to form a closed container.

3. A container blank as defined in claim 1 wherein said top and bottom partition flaps each comprise pairs of partition flaps, the partition flaps of each of said pairs of partition flaps being foldable about a common hinge line so as to lie in a plane substantially normal to the plane of said partition panel, each of said top and bottom partition flap defining means is interlockable with a selected one of said top and bottom forming flaps when folded to form said closed top and bottom covers for a container formed from said blank.

4. A container blank as defined in claim 3 wherein each of said selected ones of said top forming flaps defines a locking tab foldable outwardly of the plane of its respective top forming flap, and wherein each of said top partition flaps includes at least one slit therethrough adapted to receive the locking tab of an associated one of said selected top forming flaps in locking relation therewith when said top forming flaps are folded to form said closed top cover.

5. A container blank as defined in claim 3 wherein each flap of said pair of bottom partition flaps defines a locking tab foldable outwardly of the plane of its respective partition flap, and wherein each of said selected ones of said bottom forming flaps includes at least one slit therethrough adapted to receive the locking tab of an associated one of said pair of bottom partition flaps when said bottom forming flaps are folded to form said closed bottom cover.

6. A container blank as defined in claim 5 wherein each of said selected ones of said bottom forming flaps includes two parallel spaced slits therethrough, and wherein each of said locking tabs defined in said bottom partition flaps has a length, when folded outwardly from its respective bottom partition flap, sufficient to be received through one slit of the associated pair of slits in a first direction and through the other slit of the associated pair of slits in a direction opposite to said first direction.

7. A container blank as defined in claim 1 wherein selected ones of said two pairs of wall panels have hand holes therethrough facilitating lifting of a container made from said blank, said top forming flaps hingedly connected to said selected ones of said pairs of wall panels having reinforcing panels defined therein and foldable outwardly of the planes of the respective top forming flaps so as to lie in juxtaposed relation to the associated wall panel adjacent the hand hole therein, whereby said selected ones of said pairs of wall panels are reinforced in the area of their respective hand holes.

8. A container blank as defined in claim 7 wherein said reinforcing panels each have a retaining flap foldable outwardly from the reinforcing panel, said retaining flaps being adapted to be inserted through the associated hand holes for retaining the associated reinforcing panel in said juxtaposed relation.

9. A container blank as defined in claim 1 wherein said pairs of wall panels are generally rectangular in plane configuration, said partition panel being secured to said one of said two wall panel portions along a hinge line parallel to the hinge lines of said two pairs of wall panels.

10. A container blank as defined in claim 9 wherein said partition glue-flap is hingedly secured to said partition panel along a hinge line parallel to the hinge connection of said partition panel to said one of said two wall panel portions.

11. A container blank as defined in claim 10 wherein said container glue-flap is disposed parallel to said hinge lines of said two pairs of wall panels.

12. A container blank as defined in claim 1 wherein said top and bottom forming flaps are of equal width, considered as the dimension perpendicular to their respective hinge connections to said wall panels.

13. A container made from a unitary blank, said container comprising first and second pairs of opposed spaced wall panels, a plurality of top forming flaps hingedly connected to said wall panels and foldable into a closed top, a plurality of bottom forming flaps hingedly connected to said wall panels and foldable into a closed bottom, said top and bottom forming flaps defining with said side panels an interior chamber when folded to form said closed top and bottom, a partition panel integrally connected to one wall panel of one of said pairs of wall panels, said partition panel being connected to the opposed wall panel of said one of said pairs and extending across said interior chamber to establish two compartments within said container, said partition panel having first locking flap means foldable into a plane substantially perpendicular to the plane of said partition panel, at least one of said top forming flaps having means cooperable with said first locking flap means to retain said one of said top forming flaps in its said folded top forming position, the remaining ones of said top forming flaps being retained in their said folded positions by said one of said top forming flaps, said partition panel having second locking flap means foldable into a plane substantially normal to the plane of said partition panel, at least one of said bottom forming flaps having means cooperable with said second locking flap means to retain said one of said bottom forming flaps in its said folded bottom forming position, the remaining ones of said bottom forming flaps being cooperable with said one of said bottom forming flaps to retain said bottom flaps in their said folded positions whereby self-locking of said top and bottom end flaps in their said closed positions is effected.

14. A container as defined in claim 13 wherein said first locking flap means comprises a pair of top locking flaps foldable into said plane substantially perpendicular to the plane of said partition panel, each of said top locking flaps having at least one slit therethrough, and wherein two of said top forming flaps each have a locking tab manipulatable to be received through the slit in an associated one of said pair of top locking flaps in interlocking relation therewith so as to maintain said top forming flaps in their folded closed top forming positions.

15. A container as defined in claim 13 wherein said second locking flap means comprises a pair of bottom locking flaps foldable into said plane substantially perpendicular to the plane of said partition panel, each of said bottom locking flaps having a partition locking tab foldable outwardly of the plane of its associated bottom locking flap, two of said bottom forming flaps each having a slit therethrough adapted to receive one of said partition locking tabs therethrough in interlocking relation therewith so as to maintain said bottom forming flaps in their said folded closed bottom forming positions.

16. A container as defined in claim 14 wherein said second locking flap means comprises a pair of bottom locking flaps foldable into said plane substantially perpendicular to the plane of said partition panel, each of said bottom locking flaps having a partition locking tab foldable outwardly of the plane of its associated bottom locking flap, two of said bottom forming flaps each having a slit therethrough adapted to receive one of said partition locking tabs therethrough in interlocking relation therewith so as to maintain said bottom forming flaps in their said folded closed bottom forming positions.

17. A container as defined in claim 13 wherein each wall panel of a selected pair of said wall panels has a hand hole therethrough facilitating lifting of the container, the top forming flap hingedly connected to each wall panel of said selected pair of wall panels having a reinforcing panel defined therein and foldable outwardly of the plane of its respective top forming flap so as to lie in juxtaposed relation to the associated wall panel adjacent the hand hole therein when said top forming flaps are folded to their said closed top positions, whereby each wall panel of said selected pair of wall panels is reinforced in the area of its hand hole.

18. A container as defined in claim 17 wherein each of said reinforcing panels has a retaining flap foldable outwardly from the reinforcing panel, each of said retaining flaps being adapted to be inserted through its associated hand hole for retaining the associated reinforcing panel in said juxtaposed relation.

19. A container as defined in claim 13 wherein said wall panels are generally rectangular and selectively interconnected at their lateral edges along parallel hinge lines, said partition panel being integrally connected to its said one wall panel along a hinge line parallel to the hinge line connections of said wall panels.

* * * * *